United States Patent [19]

Jeschke

[11] 4,154,165

[45] May 15, 1979

[54] DRIVE SYSTEM FOR ROTARY PRINTING PRESSES

[75] Inventor: Willi Jeschke, Heidelberg, Fed. Rep. of Germany

[73] Assignee: Heidelberger Druckmaschinen Aktiengesellschaft, Heidelberg, Fed. Rep. of Germany

[21] Appl. No.: 826,702

[22] Filed: Aug. 22, 1977

[30] Foreign Application Priority Data

Aug. 21, 1976 [DE] Fed. Rep. of Germany ..... 2637795

[51] Int. Cl.[2] ..... B41F 5/12; B41F 5/06; B41F 7/02

[52] U.S. Cl. ..... 101/177; 101/180

[58] Field of Search ..... 101/177, 179, 180, 181, 101/182, 183, 184, 136, 137, 138, 139, 140, 178, 185, 220, 221, 224, 219, 212, 142, 143, 144

[56] References Cited

U.S. PATENT DOCUMENTS

| | | | |
|---|---|---|---|
| 1,312,151 | 8/1919 | Barber | 101/180 |
| 3,691,948 | 9/1972 | Southam et al. | 101/183 |
| 3,742,849 | 7/1973 | Greiner et al. | 101/220 |

*Primary Examiner*—J. Reed Fisher
*Attorney, Agent, or Firm*—Herbert L. Lerner

[57] ABSTRACT

A rotary printing machine having a plurality of serially disposed printing units, each including two blanket cylinders in mutual contact and two plate cylinders respectively cooperating with one of the blanket cylinders, and a main drive system individually driving each of the plate cylinders, the main drive system of each of the printing units comprising two spur gears in mutually meshing engagement and in meshing engagement with the spur gears of the respective main drive system of the printing units immediately adjacent thereto, each of the plate cylinders having a drive gear in meshing engagement with one of the two spur gears and, in combination with the main drive system, a drive system serially associated therewith and comprising two additional spur gears coupling each of the plate cylinders to a respective blanket cylinder, the additional spur gears being disposed adjacent the main drive system in a gear line different from that of the main drive system.

2 Claims, 4 Drawing Figures

DRIVE SYSTEM FOR ROTARY PRINTING PRESSES

The invention relates to a drive system for rotary printing machines, more particularly web-fed rotary offset printing preses, the drive system being connected in series with a main drive system for the printing units of the machine, each of the printing units including two blanket cylinders in mutual contact, each of the blanket cylinders cooperating with a plate cylinder, and each plate cylinder being driven individually by the main drive system.

When operating such offset printing machines with two blanket cylinders in mutual contact, so-called blanket-blanket presses, certain problems arise with the printing of high quality work, the causes of which that are due to the machine, being attributable, at least in part, to the drive system. The main problem of this machine is that the web printed in the first printing unit must exhibit practically no deviation in the relative position thereof to the blanket and plate cylinders in each further printing unit. If such a deviation in position occurs, so-called doubling results therefrom. Where high standards are imposed on the printing result or printed product, doubling cannot be accepted or tolerated consequently resulting in an increase in the amount of soiled and wasted paper.

The cause of the doubling existing in the heretofore known drive systems is to be found in rotational errors or faults of the individual cylinders of a printing unit and also in rotational errors or faults of a first printing unit with reference to the other printing units. Thus, such rotational errors or faults may arise, for example, from a twisting of the longitudinal shaft under the action of the drive force increasing from printing unit to printing unit. Rotational errors or faults also occur with angular transmissions such as bevel gears, for example, which are conventionally used at present, whose rotational errors or faults being due to the inaccuracies of production present therein.

In another proposal (German Patent DT-PS 2 014 753), a braking device is provided on each blanket cylinder in order to overcome the problem with the bevel gear transmission used therewith, namely, avoiding the backlash occurring in the drive gears under varying loads. In this regard, the drive occurs respectively through bevel gear transmissions to the plate cylinders and from there to the last links, respectively, of the drive chain and on to the blanket cylinders.

The braking devices on the blanket cylinders, which are supposed to prevent backlash in the numerous bevel gear sets and produce a tooth flank change due to the braking moment which they exert, represent an additional mechanical outlay in the machine, which is reflected in correspondingly increased costs. A further additional cost factor of considerable importance is, also, the additional power which has to be exerted by the driven, that must be converted by the braking devices into wasted heat which is, in fact, detrimental to the printing unit. This results not only in considerable energy costs, but also in additional wear of all the driving and transmission elements.

Another heretofore known construction (German Published Non-Prosecution Application DT-OS 2 260 147) attempts to eliminate doubling caused by rotational errors or faults, by providing that all the printing units are disposed one behind the other i.e. serially, in a drive chain continuous from the first to the last printing unit and that, at the end of this drive chain i.e. opposite where the drive forces are introduced, a braking device is located. In order to transmit the driving forces between the individual printing units, longitudinal shafts are again used, and transmit the driving forces between the individual plate cylinders of the printing units through bevel gear transmissions and intermediate gears. Wear, and consequent backlash with the multiplicity of tooth meshings is further increased by the braking device. Also, this last-mentioned construction provides a solution wherein, in addition to considerable backlash in the chain of driving gears, additional expense for mechanical means, for wear to gears and for energy costs for driving the machine is required.

Such an outlay in conjunction with a high cost burden is intolerable, especially for small format-printing machines. It is accordingly an object of the invention to provide a drive system of the foregoing general type which is optimally free of rotational errors or faults and has little backlash and low wear, the technical outlay by the printing press being minimal and the operation of the printing machine requiring the least possible energy consumption.

With the foregoing and other objects in view, there is provided, in accordance with the invention, in a rotary printing machine having a plurality of serially disposed printing units, each including two blanket cylinders in mutual contact and two plate cylinders respectively cooperating with one of the blanket cylinders, and a main drive system individually driving each of the plate cylinders, the main drive system of each of the printing units comprising two spur gears in mutually meshing engagement and in meshing engagement with the spur gears of the respective main drive systems of the printing units immediately adjacent thereto, each of the plate cylinders having a drive gear in meshing engagement with one of the two spur gears and, in combination with the main drive system, a drive system serially associated therewith and comprising two additional spur gears coupling each of the plate cylinders to a respective blanket cylinder, the additional spur gears being disposed adjacent the main drive system in a gear line different from that of the main drive system.

The invention of the instant application thus uses as the main drive system thereof a gear train with two spur gears for each printing unit, the spur gears being manufactured with very high precision at relatively low production costs. By virtue of this high-precision manufacture, the gears of the drive system can be adjusted largely free of backlash. Heretofore known bevel gear sets, even for a considerably higher technical and financial outlay, can at best be manufactured with a grade of quality that is at least one grade lower than for spur gears. The toothing errors or faults, which are consequently present in the bevel gears, take effect immediately as rotational errors or faults. Moreover, the construction according to the invention necessitates altogether fewer meshings of teeth and no additional braking devices, so that the invention creates an inexpensive and rigid drive system free of backlash, wherein no disturbing rotational errors or faults can arise, and doubling is thereby eliminated.

In accordance with another feature of the invention, the two spur gears of the main drive system of each of the printing units have diameters which, together, approximately correspond to the spacing of the respective printing units. Intermediate or lay gears and consequent additional meshings of teeth are avoided by the use of the two large spur gears.

To effect exact regulation of the peripheral register, the two spur gears of the plate cylinders of each printing unit may be provided with a peripheral adjustment means for plate and blanket cylinders. In accordance with a further feature of the invention, the plate cylinder drive gears are axially shiftable out of engagement with the spur gears of the main drive system of the respective printing units in order that each printing unit can be uncoupled from the drive system of the printing machine and stopped.

In accordance with a concomitant feature of the invention, the two additional spur gears coupling each of the plate cylinders to a respective one of the mutually contacting blanket cylinders are in mutually meshing engagement, the two spur gears of the main drive system, the plate cylinder-drive gears and both of the pairs of additional spur gears coupling both of the plate cylinders to the respective blanket cylinders form a closed gear train held in tension by mutually opposing rotation of one of the plate cylinder-drive gears and the spur gear for driving the blanket cylinder. In this manner, all these spur gears of a printing unit can be brought into definite flank contact i.e. mutually subjected to tension or bracing and adjusted free of backlash, without requiring additional, expensive and energy-consuming means. The backlash-free adjustment of the teeth-meshing of the spur gears of two adjacent printing units is effected in conventional manner by adapting or matching the printing unit spacing or width to the engagement or meshing of the teeth.

Although the invention is illustrated and described herein as embodied in drive system for rotary printing presses, it is nevertheless not intended to be limited to the details shown, since various modifications and structural changes may be made therein without departing from the spirit of the invention and within the scope and range of equivalents of the claims.

The construction and method of the invention, however, together with additional objects and advantages thereof will be best understood from the following decription of specific embodiments when read in connection with the accompanying drawings, in which.

Figure 1:
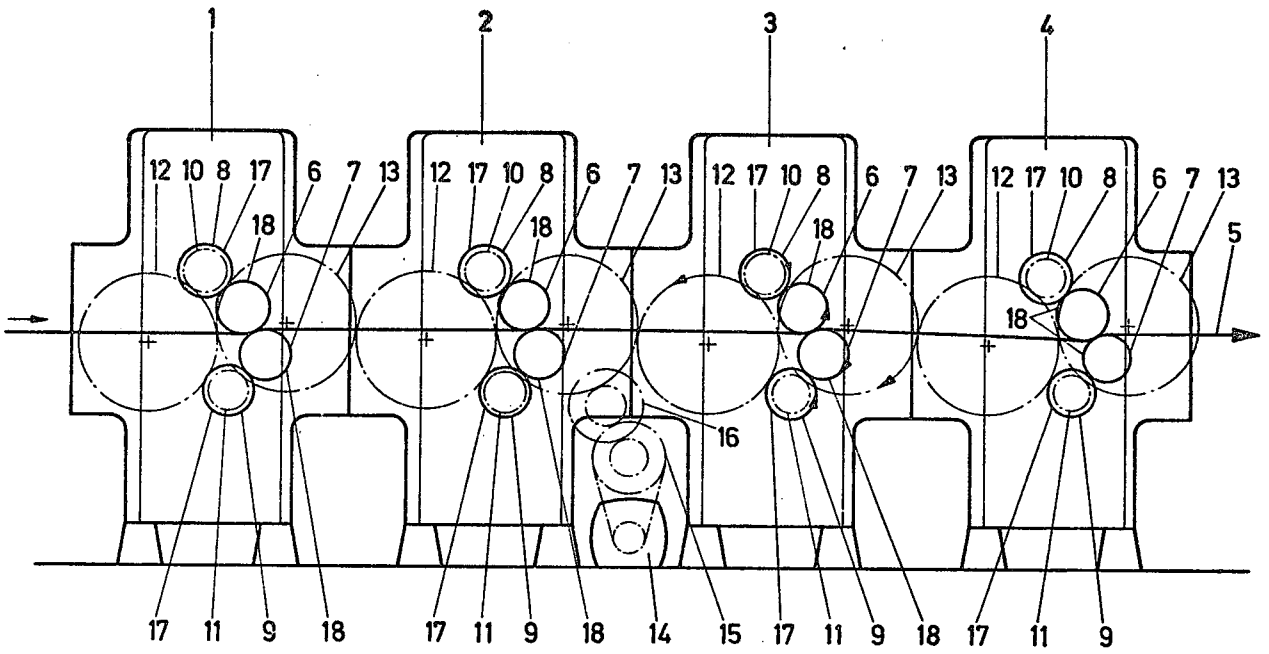
FIG. 1 is a diagrammatic side elevational view of a rotary printing press having a drive system according to the invention.

Referring now to the drawing and first, particularly, to FIG. 1 thereof, there is shown a web-fed rotary offset printing press having four printing units 1, 2, 3 and 4. A paper web 5 is passed through the printing units 1 to 4 approximately horizontally in direction of the arrow shown at the left-hand side of FIG. 1. The printing unit 1 receives the paper web from a non-illustrated reel support and the printing unit 4 feeds it, for example, to a non-illustrated drying unit. The illustrated machine is a so-called blanket-blanket printing press, wherein the paper web 5 is respectively passed through the nip between the blanket cylinders 6 and 7 and printed on.

Each of the two blanket cylinders 6 and 7 cooperates with a respective plate cylinder 8, 9. With each plate cylinder 8, 9 there is associated a plate cylinder drive gear 10, 11 each of which meshes with a respective spur gear 12, 13 of the main drive system. In the exemplary illustrated embodiment, the drive gear 10 is in meshing engagement with the spur grear 12, and the drive gear 11 with the spur gear 13. As main drive system, in this connection, two meshing gears 12 and 13 are associated with each printing unit 1 to 4.

The spur gears 12 and 13 of the main drive system of each printing unit respectively mesh with the spur gears 12 and 13 of the main drive system of the adjacent printing unit. In the exemplary illustrated embodiment, therefore, the spur gear 13 of the printing unit 1 meshes with the spur gear 12 of the printing unit 2 which, in turn, meshes with the spur gear 13 of the printing unit 2. The same meshing relationships exist between the printing units 2 and 3 and the printing units 3 and 4.

A drive motor 14 which drives the spur gear 13 of the printing unit 2 through intermediate or idler gears 15 and 16, is provided between the printing units 2 and 3.

Side-by-side with the plate cylinder drive gear 10 or 11, in another gear line, there is provided a respective spur gear 17 which coupled the respective plate cylinder 8, 9 to the respective blanket cylinder 6, 7 through the intermediary of a further spur gear 18. Thus, each pair of plate-blanket cylinders 6, 8 and 7, 9, respectively, is coupled by a pair of spur gears 17, 18, through the intermediary of the plate cylinder drive gears 10 and 11, to the spur gear 12 or 13 of the main drive system.

Figure 2:
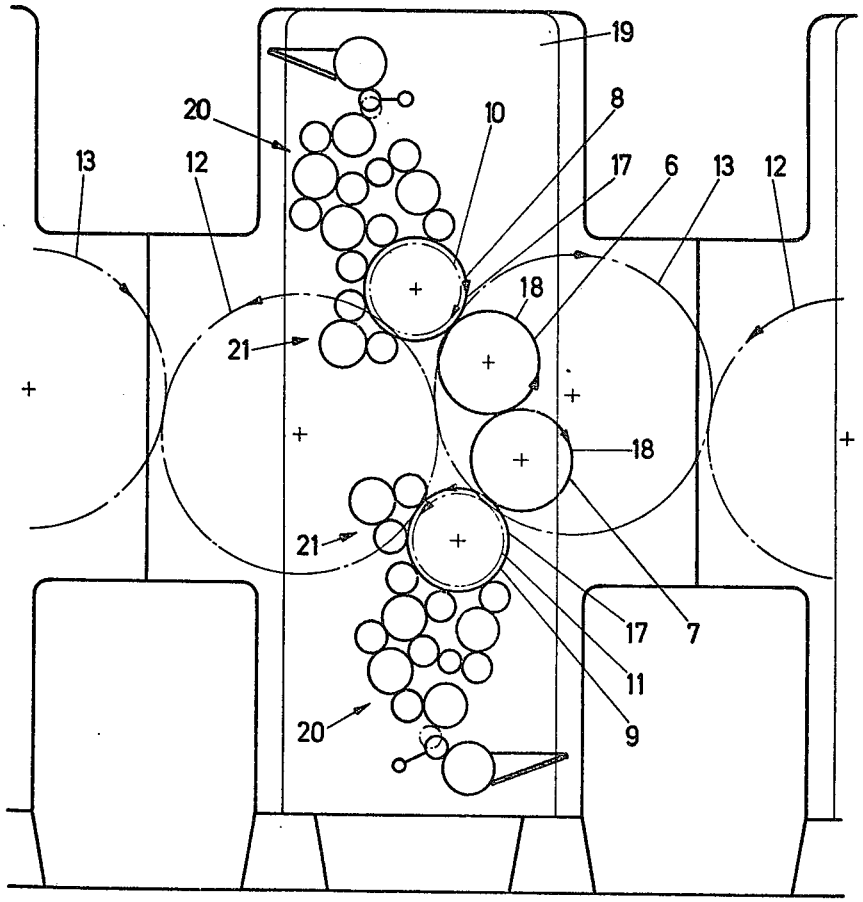
FIG. 2 is an enlarged fragmentary view of FIG. 1 showing one of the printing units thereof and parts of the printing units on both sides thereof.

The exemplary embodiment according to FIG. 2 shows a side frame 19 of a printing unit wherein the cylinders and rollers are mounted. Inking units 20 and respective damping units 21, which are associated with each plate cylinder 8, 9 are also shown in FIG. 2.

Figure 3:
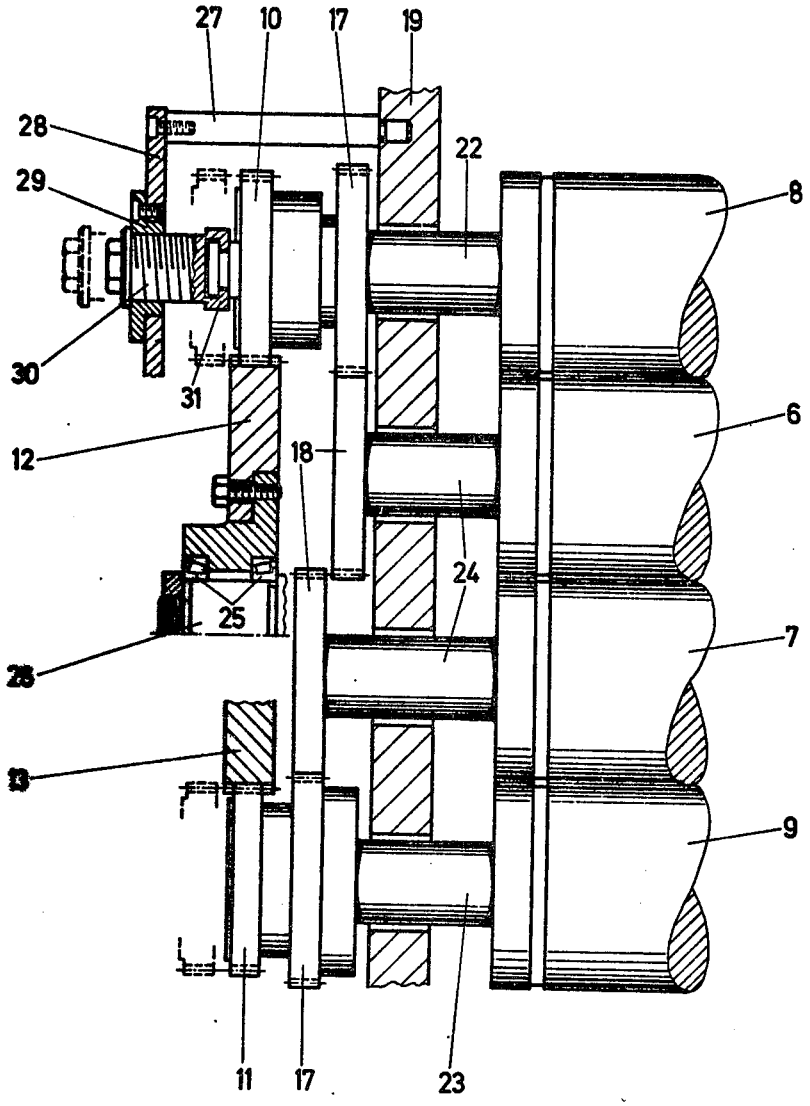
FIG. 3 is an enlarged fragmentary sectional view of the drive system of the printing unit shown in FIG. 2.

FIG. 3 illustrates how the plate-cylinder drive gears 10 and 11 are disposed on stub axles 22 and 23, and the spur gears 17 and 18 on stub axles or axle journals 22, 23 and 24. For the purpose of starting and stopping the printing operation, the two blanket cylinders 6 and 7 are pivotable in their bearings in a conventional manner so that they can be moved into and out of contact with the two plate cylinders 8 and 9 and also with one another. The bearings provided for this purpose are not shown in the drawings. The plate cylinder drive gears 10 and 11 are also provided with a non-illustrated peripheral register adjustment by which, in the embodiment of the invention according to FIG. 3, the respective plate-blanket cylinder pair is rotatable. This is facilitated by the disposition of the two spur gears 17 and 18 of each plateblanket cylinder pair 8, 6 and 9, 7 in another gear line. But it is also conceivable to dispose the two gear pairs 17, 18 in one gear line and to construct them with suitable profile shift or dislocation so that no meshing of gears occurs between the two spur gears 18. Both spur gear pairs 17, 18 are also disposed in a different gear line from that of the main drive system gears 12 and 13 and the plate cylinder drive gears 10 and 11.

The spur gears 12 and 13 of the main drive system are mounted on the side frame 19 through the intermediary of roller bearings 25 and journals or bearing pins 26. The diameters of the two spur gears 12 and 13 correspond only approximately to the width or spacing of the respective printing units 1, 2 or 2, 3 or 3, 4 because, for construction reasons, they are not disposed in one line and therefore the interval does not correspond exactly to the diameter thereof.

Mounted on the side frame 19 by stay bolts or studs 27, is a plate 28 which carries a threaded flange 29. A threaded pin 30 is rotatably provided in the latter and, through a coupling 31, shifts the plate cylinder drive gear 10 or 11 axially onto a conventional non-illustrated connection, and disengages it from the spur gear 12 or 13 of the main drive system into the position thereof shown in broken lines. By disengaging the plate cylinder drive gear 10 or 11, rotation of the plate cylinder-blanket cylinder pair 8, 6 or 9, 7 is stopped.

Figure 4:
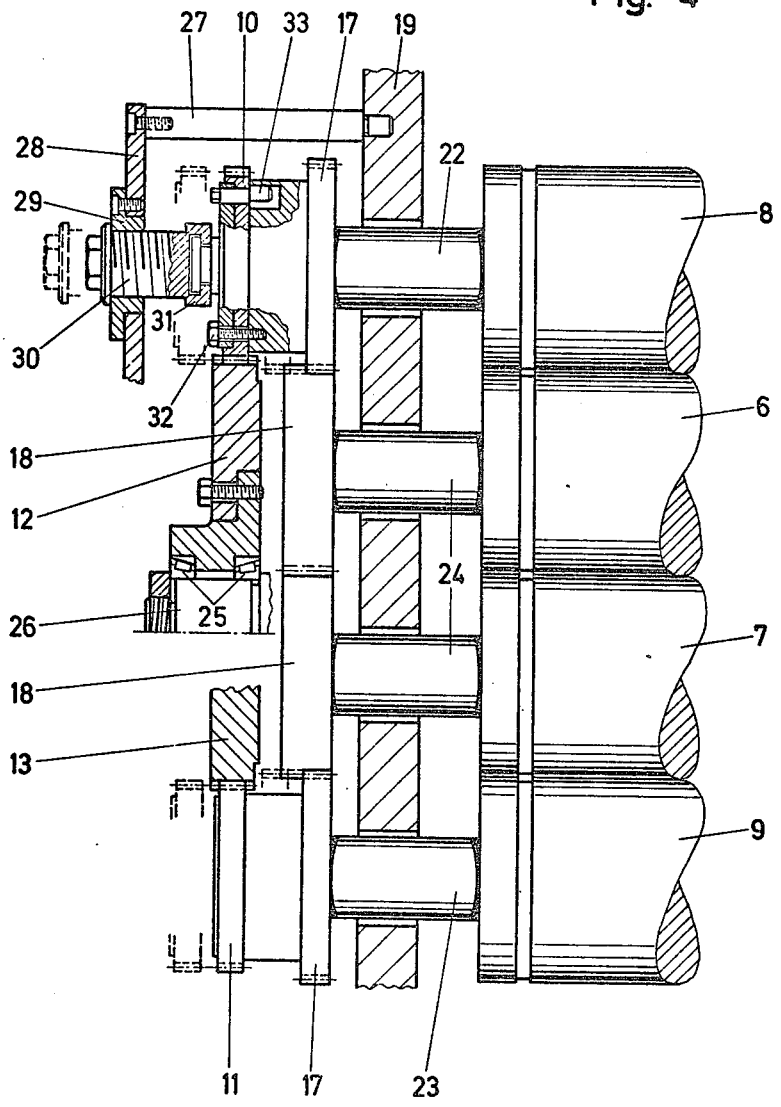
FIG. 4 is another view of FIG. 3 showing the blanket cylinder drive gears im mesh.

The exemplary embodiment according to FIG. 4 differs from that of FIG. 3 in that the two spur gears 18 of the blanket cylinders 6 and 7 are disposed in a line and are in meshing engagement so that a closed gear train formed of the two spur gears 10 and 11 and the two pairs of spur gears 17 and 18 of the plate and blanket cylinder is produced. In this case, too, a non-illustrated peripheral register adjustment is provided on the stub axes or axle journals 22 and 23 of the plate cylinders 8 and 9, respectively which, however, rotates only the respective plate cylinder 8 or 9. For the purpose of uncoupling by means of the threaded pin 30, the plate cylinder drive gears 10 and 11, in this construction, are slid conjointly with the spur gears 17 in axial direction. Disengagement occurs between the plate cylinder-drive gears 11 and the spur gear 13. In each case, the spur gear 17 remains in meshing engagement with the associated spur gear 18. Because of the closed gear train, both plate cylinder drive gears 10 and 11 are disengaged in this embodiment of FIG. 4.

After loosening clamping screws 32, the plate cylinder drive gear 10 becomes rotatable with respect to the spur gear 17 by means of eccentric bolt 33. The closed gear train, which includes the two spur gears 12 and 13 of the main drive system, the plate cylinder drive gears 10 and 11 and the two pairs of spur gears 17 and 18 of the plate and blanket cylinder can thereby be braced or subjected to tension. This tensioning or bracing has the effect that no shifting or changing from one to the other tooth flank can occur at any meshed tooth of the drive and cylinder gears of a printing unit. The tensioning or bracing is effected in the direction of the normally effective drive forces. The uncoupling of the plate cylinder drive gears 10 and 11 occurs during standstill or stoppage of the printing press, with the blanket cylinders 6 and 7 out of contact and, thereby, not with the gear train braced or under tension, since adequate tooth play is produced by the disengagement of the blanket cylinders.

There are claimed:

1. In a rotary web printing machine the combination including a plurality of serially disposed identical printing units for sequentially printing on a web along an approximately horizontal web path; each of said printing units including two blanket cylinders in mutual contact and with the web path passing through the nip thereof; two plate cylinders, each plate cylinder cooperating with a respective one of said blanket cylinders; said blanket cylinders having parallel axes relative to one another, the axis of one blanket cylinder being located over the other in a vertical direction; a main drive system individually driving each of said plate cylinders, said main drive system of each of the printing units comprising first and second spur gears in mutually meshing engagement and having parallel axes relative to one another, the axis of one spur gear being located next to the other in a substantially horizontal direction; said first and second spur gears of said main drive system being in mesh with the second and first spur gears, respectively, in each of the serially disposed printing units immediately adjacent thereto; each said plate cylinder having a spur drive gear, one said plate cylinder spur drive gear being in mesh with said first spur gear and the other said plate spur drive gear being in mesh with said second spur gear; each blanket cylinder in each said unit having a spur gear engaged with said spur gear on the adjacent plate cylinder with which it cooperates, and means for holding said first and second spur gears, said plate spur drive gear and said blanket and plate cylinder spur gears in mutual bracing engagement.

2. Rotary printing machine according to claim 1 wherein said first and second spur gears of the main drive system, said plate spur drive gear of each unit and said engaged blanket cylinder spur gear and plate cylinder spur gear form a closed gear train, and said means for holding in mutual bracing engagement are the mutually opposing rotation of said plate spur drive gear of the respective unit and the respective one of said blanket cylinder spur gears.

* * * * *